US008875887B2

(12) United States Patent
Fresnel

(10) Patent No.: US 8,875,887 B2
(45) Date of Patent: Nov. 4, 2014

(54) COVER FOR WRAPPING AT LEAST ONE ARTICLE, THE COVER BEING OF THE TYPE CONSTITUTED BY A SLEEVE OF HEAT-SHRINKABLE PLASTICS MATERIAL

(75) Inventor: Eric Fresnel, Paris (FR)

(73) Assignee: Sleever International Company, Morangis (FR)

( * ) Notice: Subject to any disclaimer, the term of this patent is extended or adjusted under 35 U.S.C. 154(b) by 1512 days.

(21) Appl. No.: 11/552,176

(22) Filed: Oct. 24, 2006

(65) Prior Publication Data

US 2007/0090012 A1 Apr. 26, 2007

(30) Foreign Application Priority Data

Oct. 25, 2005 (FR) ..... 05 10853

(51) Int. Cl.

| | |
|---|---|
| ***B65D 65/00*** | (2006.01) |
| ***B65D 71/08*** | (2006.01) |
| ***G09F 3/04*** | (2006.01) |
| ***B65D 23/08*** | (2006.01) |

(52) U.S. Cl.

CPC ..... *B65D 23/0878* (2013.01); *G09F 3/04* (2013.01); *B65D 2203/02* (2013.01)

USPC ..... 206/497; 40/306

(58) Field of Classification Search

USPC ..... 206/497; 40/306

See application file for complete search history.

(56) References Cited

U.S. PATENT DOCUMENTS 1,273,105 A * 7/1918 Van Dyke et al. ..... 283/106
4,173,659 A * 11/1979 Dubois et al. ..... 427/551
4,318,235 A * 3/1982 Augeri ..... 40/306
5,571,358 A * 11/1996 Napier et al. ..... 156/227
5,704,648 A * 1/1998 Brown et al. ..... 283/81
5,829,789 A * 11/1998 Treleaven et al. ..... 283/81

(Continued)

FOREIGN PATENT DOCUMENTS

| | | |
|---|---|---|
| EP | 0670807 B1 | 10/1996 |
| EP | 0775643 A1 | 5/1997 |
| EP | 1294614 B1 | 8/2004 |
| FR | 2698851 A1 | 12/1992 |

OTHER PUBLICATIONS

French Search Report for Serial No. 0510853 dated May 11, 2006.

*Primary Examiner* — Anthony Stashick
*Assistant Examiner* — Blaine Neway
(74) *Attorney, Agent, or Firm* — McCormick, Paulding & Huber LLP

(57) ABSTRACT

The present invention relates to a cover for wrapping at least one article, the cover being of the type constituted by a sleeve of heat-shrinkable plastics material suitable for closely surrounding at least a portion of the article or a group of articles. In accordance with the invention, the sleeve is constituted by superposing at least two walls secured to each another by detachable adhesive means, said walls having shrinkage characteristics that are essentially identical, and the outermost wall of the sleeve also presenting, through its entire thickness, at least one cut defining a detachable circumferential strip, said circumferential strip being printed so as to present respective patterns of printing that appear on each of its sides, the other wall(s) also presenting a pattern of printing behind the detachable circumferential strip that appears after said circumferential strip has been detached.

20 Claims, 5 Drawing Sheets

(56) References Cited

U.S. PATENT DOCUMENTS 6,047,488 A * 4/2000 Tuszkiewicz ..... 40/306
6,073,377 A * 6/2000 Mehta ..... 40/638
6,322,864 B1 * 11/2001 Fresnel ..... 428/34.9
6,581,973 B2 * 6/2003 Levine et al. ..... 283/81
6,722,495 B2 * 4/2004 Fresnel ..... 206/232
6,770,345 B2 * 8/2004 Sellars ..... 428/40.1
2003/0168373 A1 9/2003 Fresnel
2004/0118728 A1 * 6/2004 Friedrich et al. ..... 206/423

* cited by examiner

COVER FOR WRAPPING AT LEAST ONE ARTICLE, THE COVER BEING OF THE TYPE CONSTITUTED BY A SLEEVE OF HEAT-SHRINKABLE PLASTICS MATERIAL

CROSS-REFERENCE TO RELATED APPLICATIONS

Applicant hereby claims foreign priority benefits under U.S.C. §119 from French Patent Application No. 05 10853 filed on Oct. 25, 2005, the contents of which are incorporated by reference herein.

FIELD OF THE INVENTION

The present invention relates to wrapping articles, and in particular to packaging consumer goods such as foods, chemicals, cosmetics, or pharmaceuticals, that generally require consumer or user information, or indeed other information of a purely commercial kind.

More precisely, the invention relates to a cover for wrapping at least one article, the cover being of the type constituted by a sleeve of heat-shrinkable plastics material suitable for closely surrounding at least a portion of the article or a group of articles, said sleeve including the possibility of integrating an information medium.

BACKGROUND OF THE INVENTION

Document EP-A-0 670 807 in the name of the Applicant discloses a cover of the above-specified type presenting an additional flap that defines a stub that can be detached by tearing along two parallel lines that extend along generator lines of the sleeve. The additional flap co-operates with the facing face of the main portion of the sleeve to form a pocket for containing an explanatory insert constituted by one or more sheets.

In a variant, document EP-A-0 775 643 in the name of the Applicant discloses another cover having an additional flap, in which the stub can be detached by tearing along two parallel lines that extend along a circumferential direction of the sleeve, by pulling on an associated end tongue. In that variant also, the additional flap co-operates with the main portion of the sleeve to define a pocket in which an insert is inserted, and to which access can be obtained by detaching the stub.

The drawback of the solutions disclosed in the above-mentioned documents lies essentially in that the inserts associated with the covers are inserted manually, where such insertion requires the presence of a specialized workforce on site, thereby slowing down fabrication rates and representing a non-negligible fraction of the cost of fabricating covers.

To overcome those drawbacks, a solution has also been proposed in which an adhesive strip extends along a generator line of the sleeve on the outside face of the main portion thereof, said strip serving to hold a flat article in the pocket formed by the additional flap, in such a manner that said article is held captive behind the detachable stub and can be recovered once said stub has been detached, as described in document EP-A-1 294 614 in the name of the Applicant.

The above-mentioned document gives full satisfaction when covering articles of dimensions corresponding to the usual dimensions of cosmetic or pharmaceutical goods having diameters of 5 centimeters (cm) or more. However, with articles of smaller diameter, and of shape that is not necessarily cylindrical, it becomes difficult to organize a pocket containing an insert or booklet because of the small amount of space available. In addition, inserts or booklets cannot be miniaturized indefinitely, insofar as most countries have regulations specifying a minimum size for printed information, in particular legal information addressed to consumers, in order to guarantee that such information is sufficiently legible.

BRIEF SUMMARY OF THE INVENTION

An object of the invention is to improve covers of the above-specified type by devising an arrangement enabling a large area to be presented for information, even if the articles concerned are of small diameter, while nevertheless complying with a minimum size for the legibility of such information.

The above-specified technical problem is solved in accordance with the invention by a cover for wrapping at least one article, the cover being of the type constituted by a sleeve of heat-shrinkable plastics material suitable for closely surrounding at least a portion of the article or a group of articles, in which cover the sleeve is constituted by superposing at least two walls that are secured to one another by detachable adhesive means, said walls having shrinkage characteristics that are essentially identical so as to enable the sleeve to shrink uniformly onto the article or the group of articles, and the outermost wall of the sleeve further presents, through the entire thickness thereof, at least one cut defining at least part of a detachable circumferential strip, said circumferential strip being printed so as to present a pattern of printing that appears on each of its sides, the other wall(s) also presenting patterns of printing, in particular behind the detachable circumferential strip so that the corresponding pattern of printing appears after said detachable circumferential strip has been detached.

Thus, as soon as the user has detached the detachable circumferential strip, the information appearing on either side of said circumferential strip can be read, by examining the front and the back thereof, with this taking place over a length that corresponds to substantially twice the circumference of the article, assuming the article is cylindrical, with it also being possible to read the information that appears after the detachable circumferential strip has been detached, thereby optimizing availability over the entire outside surface of the portion of the cover that remains on the article or the group of articles in question.

In an advantageous embodiment, the outermost wall of the sleeve presents a tear strip along a generator line, the tear strip being defined by two parallel lines of perforations or the like, with removal of the tear strip, in particular by means of a pull tab, enabling the detachable circumferential strip to be detached subsequently.

Provision can then be made, in combination with, or as a replacement for, the above characteristic, for the outermost wall of the sleeve to present a cut defining a pull tongue at the end of detachable circumferential strip. In particular, a zone can then be provided, behind the pull tongue, that presents smaller resistance to peeling, thus enabling said tongue to be separated, or in a variant, a reinforcing strip can be provided that extends along a generator line of the sleeve.

The cover may include two parallel circumferential cuts defining an intermediate circumferential strip.

In a variant, only one cut need be provided in a high (or low) portion of the sleeve, the other edge of the circumferential strip as defined in this way then being constituted by the top (or bottom) free edge of the cut wall.

In another embodiment, an essentially axial cut is provided over the full height of the sleeve, with the edges of the circumferential strip as defined in this way being constituted by the top and bottom free edges of the cut wall.

Also advantageously, the detachable circumferential strip includes opaque means, present in its material or added to its surface, ensuring that patterns of printing appearing on either side of said circumferential strip are legible.

Provision can also be made for the detachable circumferential strip to present embossing.

Also preferably, the walls constituting the sleeve are superposed, either independently or by making one or more folds in a single wall, with detachable adhesive means being interposed.

The detachable adhesive means may be peelable or repositionable, depending on circumstances.

The detachable adhesive means may be in the form of a layer of adhesive, or of a polymer binder used during coextrusion of films constituting the walls, or indeed of electrical polarization of the facing surfaces of the walls so they present opposite electrostatic fields.

Also preferably, the walls constituting the sleeve are made from films of plastics material that are all mono-oriented, either all transversely or all longitudinally. In particular, the films constituting the walls have shrinkage curves and softening points that are essentially identical, said films possibly otherwise differing from one another in their material, and/or their color, and/or their thickness, and/or their texture.

Other characteristics and advantages of the invention appear more clearly in the light of the following description and the accompanying drawings relating to a particular embodiment.

BRIEF DESCRIPTION OF THE DRAWINGS

Reference is made below to the figures of the accompanying drawings, in which.

DETAILED DESCRIPTION OF THE INVENTION

Figure 1:
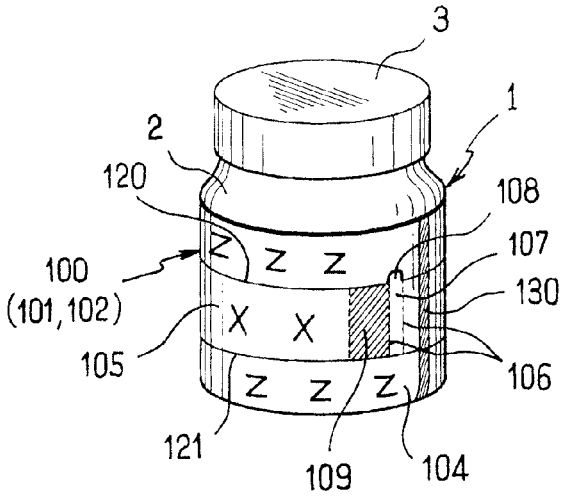
FIG. 1 is a perspective view of a container wrapped in a cover of the invention, said cover including a printed intermediate circumferential strip that is detachable, specifically by using an associated axial tear strip.

FIG. 1 shows a container 1 wrapped in a cover of the invention referenced 100. In this case the container 1 comprises a body 2 that is essentially cylindrical, together with a closure cap 3, and the wrapping cover 100 surrounds the body of the container closely by being heat-shrunk thereon.

Such a container is naturally given by way of example in order to illustrate a particular instance of an article wrapped in a cover in accordance with the invention. In particular, control over shrinkage phenomena makes it possible to envisage wrapping articles of shapes that are much more complex, while still preserving legibility of the printing carried by the sleeves constituting said wrapping.

The cover 100 which is looped by a line of bonding 130 is constituted by a sleeve of heat-shrinkable plastics material which specifically presents the feature of being constituted by superposing at least two walls that are secured to each other by detachable adhesive means. This feature can be seen more clearly in the section of FIG. 5, which shows a variant having two walls referenced 101 and 102. The walls 101 and 102 are secured to each other by detachable adhesive means organized as a layer referenced 115. In general, the detachable adhesive means covers the entire area of the cover which is shown developed flat in FIG. 4.

Figure 4:
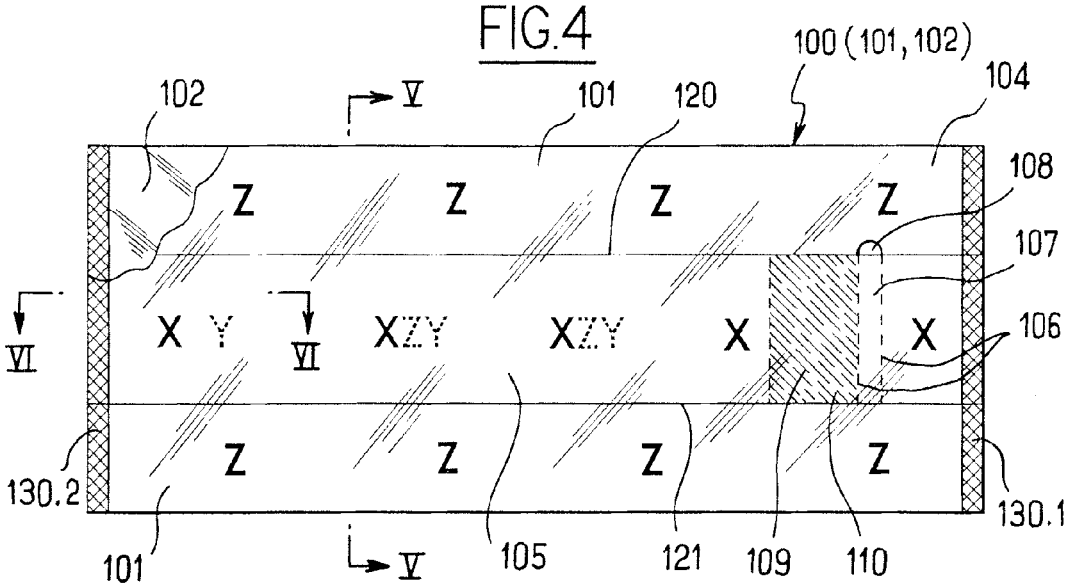
FIG. 4 is a plan view of the developed outer face of the above-specified cover, prior to the cover being configured in the shape of a sleeve.

In FIG. 4, there can be seen end zones 130.1 and 130.2 that are superposed and bonded together to form a sleeve, which sleeve is subsequently placed over the article to be wrapped, and then shrunk onto the body of said article.

As explained below, it is essential for the walls 101 and 102 to have shrinkage characteristics that are essentially identical so as to enable the sleeve 100 to shrink uniformly onto the article 1. In practice, the walls constituting the sleeve 100 are made from films of plastics material that are all mono-oriented, either all transversely or all longitudinally. It is important for the orientation mode to be the same for the superposed walls so as to avoid introducing any distortion when the sleeve is heated in order to shrink it. More precisely, provision is made for the component films 101, 102 of the walls to have shrinkage curves and softening points that are essentially identical. Shrinkage curves and softening points are the basic criteria that govern the shrinkage of heat-shrinkable films of plastics material. Naturally, the films constituting the walls 101, 102 can differ from one another in other respects, in terms of material, and/or color, and/or thickness, and/or texture.

In accordance with another characteristic of the invention, the wall 101, which is the outermost wall of the sleeve 100, also presents at least one cut going right through its thickness and defining at least part of a detachable circumferential strip referenced 105. In general, the cut(s) is/are located accurately relative to the patterns of printing carried by the detachable circumferential strip 105.

Figure 5:
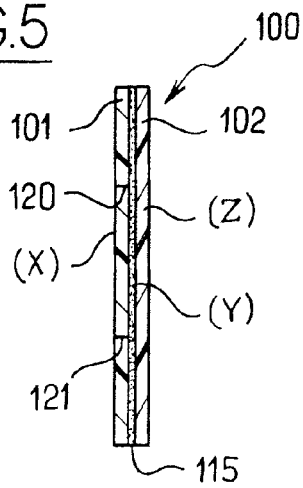
FIG. 5 is a section on line V-V of FIG. 4, showing more clearly the half-depth cut defining a detachable intermediate circumferential strip.

In FIG. 1, there can thus be seen two circumferential lines of cut 120, 121, which in this example relate to the entire circumference of the cover 100 shrunk onto the article 1. As can be seen in the section of FIG. 5, the cuts forming the lines 120, 121 go down to half-depth, i.e. each of them stops at the depth of the detachable adhesive means 115. The cuts 120, 121 can be made while the cover is flat, using mechanical cutter means (rotary blades), or using laser radiation, implementing a process that is continuous. In a variant, provision can be made for circumferential cuts to be made that are of a length that is shorter than a full circumference, with detachment then taking place in part by tearing the wall 101.

In order to be able to detach the circumferential strip 105, FIG. 1 shows that the wall 101, i.e. the outermost wall of the sleeve 100, presents an axial tear strip 107 along a generator line, and specifically over a fraction of its height, the tear strip being defined by two parallel lines of perforations 106 or the like. In this example, the tear strip 107 also presents a pull tab 108 beyond the line of cut 120, making it easier to take hold of said tear strip and to remove it, as shown diagrammatically in FIG. 2, in order subsequently to be able to detach the detachable circumferential strip 105.

Removing the tear strip 107 thus makes it possible to release a pull tongue 110 at the end of the detachable circumferential strip 105. It is then advantageous to provide a zone 109 presenting reduced resistance to peeling behind the pull tongue 110, i.e. a zone that opposes lower resistance to being pulled apart, while nevertheless remaining bonded together so as to avoid differential shrinkage (the zone that is shaded in FIGS. 1, 2, and 4), for the purpose of facilitating separation of said tongue. This zone 109 can be obtained by a local deposit of a repellent varnish.

Figure 3:
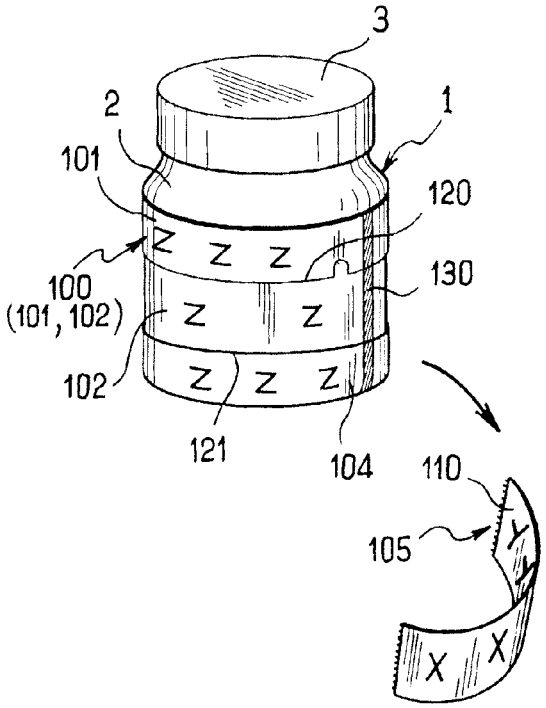
Figure 3A:
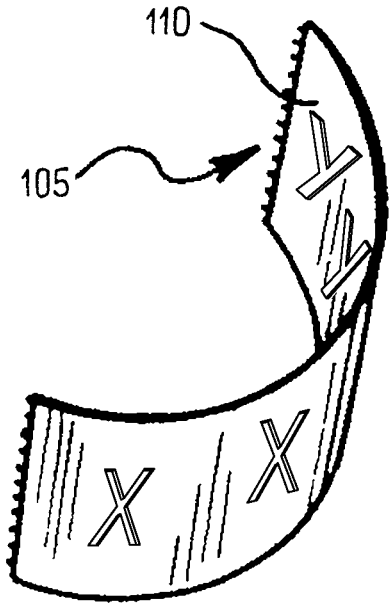
FIG. 3A is an enlarged perspective view of the deatachable circumferential strip of FIG. 3 show embossing.

It then suffices to pull the pull tongue 110 circularly around the article 1 and thus detach the entire circumferential strip 105, as shown in FIG. 3.

The printing provided on the cover 100 made in accordance with the invention is described below.

The circumferential strip 105 is printed so as to present respective patterns of printing that appear on both sides thereof. In order to ensure that the circumferential strip 105 is perfectly legible when looking at either of its faces, said strip includes means suitable for making it opaque. The opaqueness means may be present in the material of the strip by using a film made of a material that is white or colored, or else they may be applied to its surface, e.g. a printed ink or metallization printed in blank on one of the surfaces of the film. This opaqueness is essential for ensuring that the patterns of printing appearing on the sides of the circumferential strip 105 are both legible. In this respect, it should be observed that the patterns of printing could both be printed on the same side of the circumferential strip, providing opaqueness is provided by means interposed between the two patterns.

In the figures, the letters X and Y represent the patterns of printing that appear on opposite sides of the circumferential strip 105. Before the circumferential strip 105 is detached (FIG. 1), the user can see only the letters X that are visible on the outside face 104 of the cover 100. After the circumferential strip 105 has been detached (FIG. 3), the user can not only read the information represented by the letters X, but can also read other information that was previously hidden as represented by the letters Y, by looking at the opposite face of said strip. The circumferential strip 105 thus presents printed information occupying a length that is about twice the circumference of the cylindrical article in question, which is most advantageous when the article concerned is of small diameter.

Figure 2:
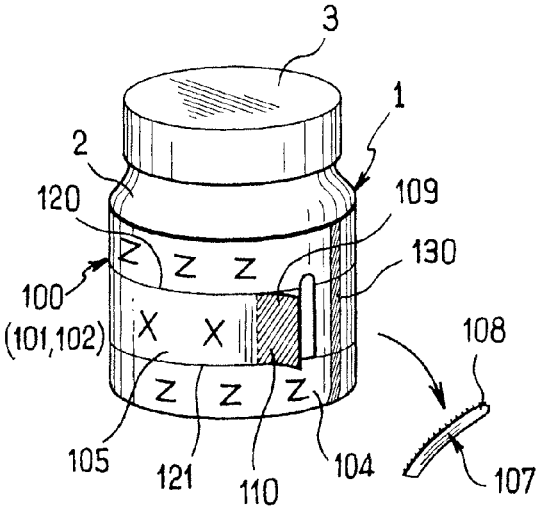
FIGS. 2 and 3 show the progressive separation of detachable elements, respectively in FIG. 2 with the axial tear strip, and then in FIG. 3 with the detachable circumferential strip, thus enabling legibility of the printed information to be optimized.

The other wall 102 of the sleeve 100 also presents at least one pattern of printing, in particular behind the circumferential strip 105, so that the corresponding pattern of printing appears once said detachable circumferential strip has been detached. In FIGS. 1 to 3, the letters Z are used to represent the patterns of printing that are visible from the outside. Before the circumferential strip 105 has been detached (FIG. 1), the patterns of printing Z are visible above and below said strip. Thereafter, once the circumferential strip 105 has been detached (FIG. 3), the central portion of the wall 102 that is now visible together with its information offers an additional area for printing (letters Z) that was previously masked by the detachable circumferential strip 105.

Thus, with the detachable circumferential strip 105, it is possible to make printed information available occupying a length corresponding to about three times the circumference of the article.

In the flat view of FIG. 4, the letters X, Y, and Z are shown diagrammatically, the letters Y being represented by back-to-front dashed lines since they only appear once the circumferential strip 105 has been detached and turned over, and the letters Z which are behind the circumferential strip 105 are shown (the right way round) in dashed lines, since they appear only after said circumferential strip has been detached. The letters X, Y, and Z are also marked on the section of FIG. 5.

Figure 6A:
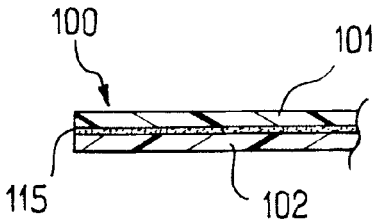
FIGS. 6A and 6B are sections on line VI-VI of FIG. 1, showing variants of walls superpositioned, respectively in an independent mode and in a folded mode with detachable adhesive means being interposed.
Figure 6B:
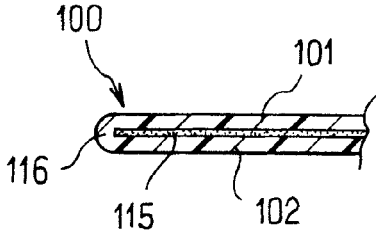

As can be seen in FIGS. 6A and 6B, provision can be made to the walls 101,102 constituting the sleeve 100 to be superposed either in independent manner (FIG. 6A), or by folding a single wall in half (FIG. 6B), with detachable adhesive means 115 being interposed between the walls.

Figure 7:
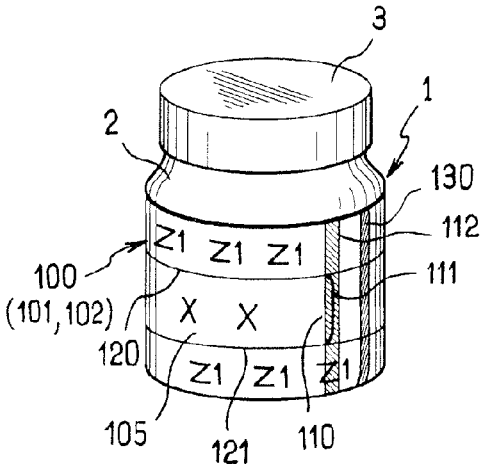
FIGS. 7 and 8 are perspective views analogous to those of FIGS. 1 to 3, showing a variant of the above cover in which the detachable intermediate circumferential strip presents a pull tongue.

FIG. 7 is analogous to above-described FIG. 1, and shows a variant in which the outermost wall 101 of the sleeve 100 presents an additional cut 111 that co-operates with the circumferential cuts 120, 121 to define a pull tongue 110 at the end of the detachable intermediate circumferential strip 105.

Figure 8:
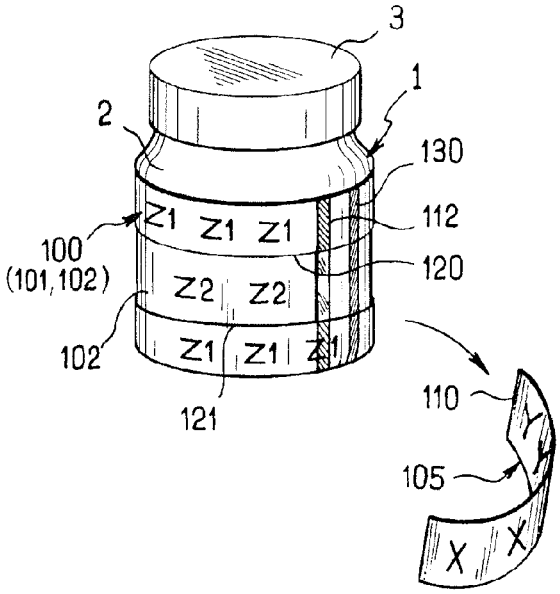

The presence of this cut 111 might run the risk of weakening the cover 100 while it is being shrunk onto the article. In which case, use can be made of a reinforcing technique that is described in document EP-A-0 775 643 in the name of the Applicant. A reinforcing strip referenced 112 is then used that is disposed along a generator line of the sleeve 100, in this case over the full height thereof, said reinforcing strip being provided behind the end edge of the pull tongue 110. Specifically, given that the sleeve 100 is constituted by two walls 101, 102, the reinforcing strip 112 is interposed between the two walls level with the cut 111. Thus, the circumferential strip 105 is detached merely by taking hold of the end of the tongue 110 and then pulling around the article, as shown in FIG. 8. Information is then available that can be seen by examining both faces of the circumferential strip 105, specifically information represented by the letters X and Y. These figures also show a variant in which the wall 102 carries information that differs depending on its location, represented by letters Z1 and Z2, where the information corresponding to the letter Z2 becomes visible only once said circumferential strip 105 has been detached.

Figure 10:
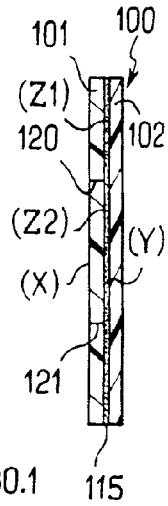
FIG. 10 is a section view on line X-X of FIG. 9.

Once more, as can be seen in the section of FIG. 10, the lines of cut 120, 121 go down to half-depth, i.e. through the entire wall thickness of the film 101 down to the depth of the detachable adhesive means 115.

Figure 11A:
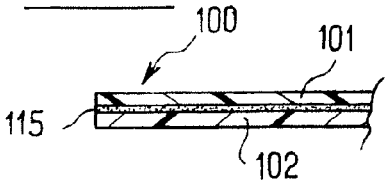
FIGS. 11A and 11B are sections on line XI-XI of FIG. 9 showing two variants of superposition, as in above FIGS. 6A and 6B.
Figure 11B:
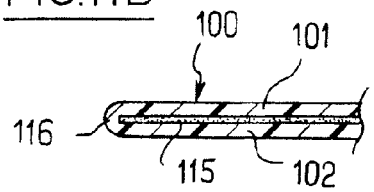

As above, the walls can be assembled by being superposed independently (FIG. 11A) or by folding a single wall in half (FIG. 11B), with a layer of detachable adhesive means 115 being interposed between them.

Figure 12A:
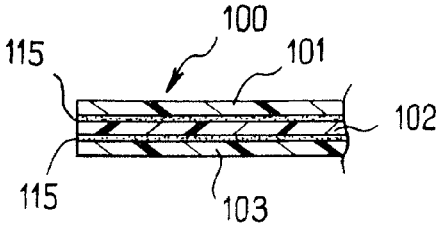
FIGS. 12A and 12B are section views analogous to those of FIGS. 11A and 11B, showing yet other variants in which the sleeve is constituted by superposing three walls that are secured to one another by detachable adhesive means.
Figure 12B:
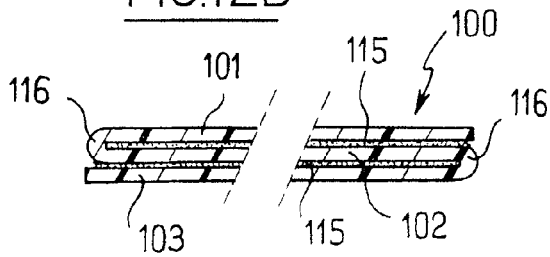

FIGS. 12A and 12B show other variants in which the sleeve 100 is constituted by superposing three walls 101, 102, and 103 which are likewise secured to one another by detachable adhesive means 115. These figures show an arrangement using direct superposition (FIG. 12A) or by making two folds (FIG. 12B) in a single wall of film. These arrangements based on three layers make further possibilities available for presenting information, however they also complicate the printing techniques required, particularly with a single wall that is folded in thirds as shown in FIG. 12B.

If so desired, it is also possible to provide for the detachable circumferential strip 105 to present embossing (variant not shown). This can present an advantage in enabling the circumferential strip to be recognized by touch, and also serves, when using a detachable adhesive that is repositionable, to make it easier to apply the strip flat onto some other backing once the strip has been detached.

In general, it is possible to use detachable adhesive means that are peelable or repositionable.

The adhesive means used may comprise different types: they could be constituted by a layer of adhesive, or in a variant by a polymer binder used during coextrusion of the films constituting the superposed walls. It is also possible to use electrical polarization of the facing wall surfaces by electric field reversal (the adhesive layer is then immaterial, thus making it possible to produce embodiments that are thin even when comprising a plurality of walls).

A cover is thus provided that optimizes surface area for printing, even for articles of small diameter, while nevertheless complying with a minimum size for the text so as to ensure that it is legible.

Figure 13:
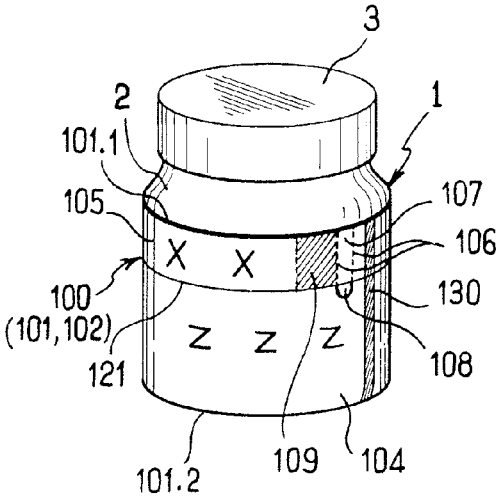
FIGS. 13 to 15 are perspective views showing yet other variants having a single cut, with a circumferential cut that is high (FIG. 13) or low (FIG. 14), or a cut that is essentially axial (FIG. 15), the detachable circumferential strip then having the same height as the sleeve.
Figure 14:
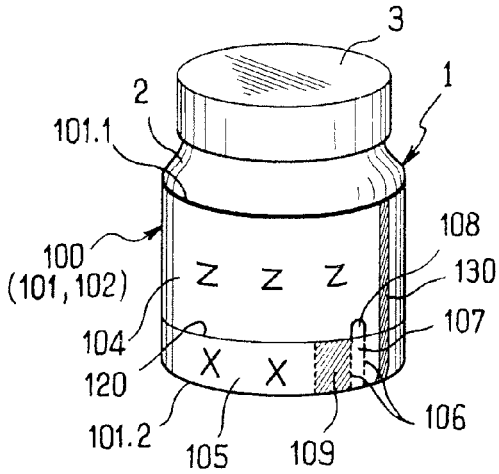

Numerous other variants can be provided that differ from the above in the way in which the detachable circumferential strip is arranged, for example by providing for a top (or bottom) strip that is defined by a single circumferential cut to half-depth, with the other edge of the detachable circumferential strip then being the top (or bottom) free edge of the sleeve. Such variants are shown in FIG. 13 for a top strip 105 defined by a single circumferential cut 121 provided in the high portion of the sleeve 100, and in FIG. 14 for a bottom strip 105 defined by a single circumferential cut 120 provided in the low portion of the sleeve 100 (the top and bottom free edges of the cut wall 101 being given respective references 101.1 and 101.2). FIGS. 13 and 14 show an arrangement using an axial tear strip 107 as in FIGS. 1 to 4, however that is merely one possible example. It is also possible to provide a plurality of such circumferential strips, using more complex cuts down to half-depth in the thickness of the outermost wall constituting the sleeve (variant not shown herein).

Figure 9:
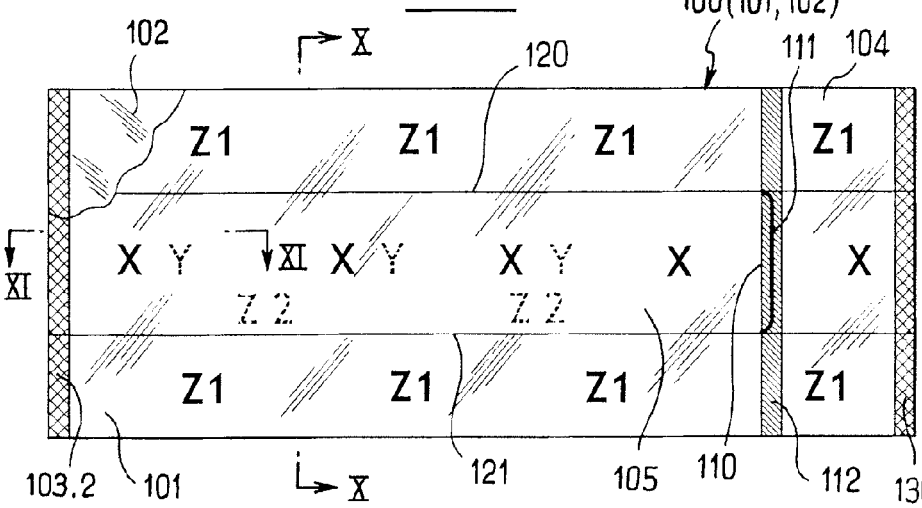
FIG. 9 is plan view analogous to FIG. 4, showing the cover of FIGS. 7 and 8 developed flat.
Figure 15:
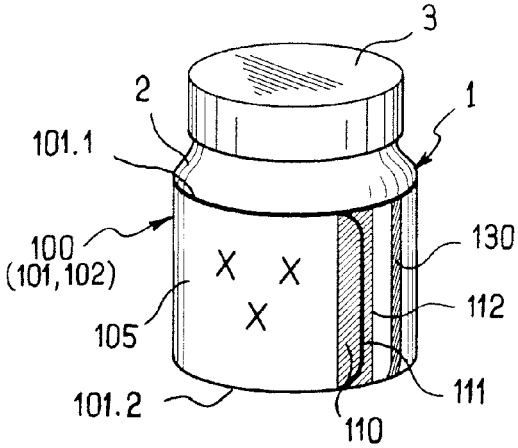

Provision could also be made for a single, essentially axial cut to be provided over the entire height of the sleeve 100 without any circumferential cut, as shown in FIG. 15 with the cut 111 (associated with a reinforcing strip 112 behind said cut, as in FIGS. 7 to 9). In this configuration, the detachable circumferential strip 105 has the same height as the sleeve 100, the edges of said strip then being constituted by the top and bottom free edges 101.1 and 101.2 of the cut wall 101.

Finally, although not shown herein, provision could be made for a cover for wrapping a group of articles, as also described in above-mentioned document EP-A-0 775 643 in the name of the Applicant. A two-compartment sleeve is then used with a second bond line arranged at a distance from the bond line 130 so as to define an intermediate membrane. The organization of the detachable circumferential strip otherwise remains unchanged.

The invention is not restricted to the embodiments described above, but on the contrary covers any variant using equivalent means to reproduce the essential characteristics specified above.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A cover for wrapping at least one article, the cover constituted by a sleeve of heat-shrinkable plastics material suitable for closely surrounding at least a portion of the article or a group of articles, wherein the sleeve is constituted by a first wall having a first edge and a second edge and a second wall having a first edge and a second edge, wherein said first edge of said first wall is substantially in register with said first edge of said second wall and said second edge of said first wall is substantially in register with said second edge of said second wall, wherein said walls are superposed by securing said first edges to said second edges, wherein said first and second walls are secured to one another by detachable adhesive means generally covering the entire area of said first and second walls, said walls having shrinkage characteristics that are essentially identical so as to enable the sleeve to shrink uniformly onto the article or the group of articles, and the second wall of the sleeve further presents, through the entire thickness thereof, at least one cut defining at least one part of a detachable circumferential strip, said circumferential strip being printed so as to present a pattern of printing that appears on each of its sides, said first wall also presenting patterns of printing, in particular behind the detachable circumferential strip so that the corresponding pattern of printing appears after said detachable circumferential strip has been detached.

2. The cover according to claim 1, wherein the second wall of the sleeve presents a tear strip along a generator line, the tear strip being defined by two parallel lines of perforations or the like, with removal of the tear strip, in particular by means of a pull tab, enabling the detachable circumferential strip to be detached subsequently.

3. The cover according to claim 1, wherein the second wall of the sleeve presents a cut defining a pull tongue at the end of detachable circumferential strip.

4. The cover according to claim 3, wherein a zone presenting reduced resistance to peeling is provided behind the pull tongue, thereby enabling said tongue to be separated.

5. The cover according to claim 3, wherein a reinforcing strip is provided behind the end edge of the pull tongue, being disposed along a generator line of the sleeve.

6. The cover according to claim 1, including two parallel circumferential cuts defining an intermediate circumferential strip.

7. The cover according to claim 1, including a single circumferential cut in the high portion of the sleeve, the other edge of the circumferential strip as defined in this way being constituted by the top free edge of the cut wall.

8. The cover according to claim 1, including a single circumferential cut in the low portion of the sleeve, the other edge of the circumferential strip as defined in this way being constituted by the bottom free edge of the cut wall.

9. The cover according to claim 1, including a cut that is essentially axial over the entire height of the sleeve, the edges of the circumferential strip as defined in this way being constituted by the top and bottom free edges of the cut wall.

10. The cover according to claim 1, wherein the detachable circumferential strip includes means providing opaqueness, present in the mass of its material or applied to its surface, ensuring that the patterns of printing appearing on both sides of said circumferential strip are legible.

11. The cover according to claim 1, wherein the detachable circumferential strip presents embossing.

12. The cover according to claim 1, wherein the walls constituting the sleeve are superposed independently, with said detachable adhesive means being interposed.

13. The cover according to claim 1, wherein the walls constituting the sleeve are superposed by folding a single wall, with said detachable adhesive means being interposed.

14. The cover according to claim 12, wherein the detachable adhesive means are peelable.

15. The cover according to claim 12, wherein the detachable adhesive means are repositionable.

16. The cover according to claim 1, wherein the adhesive means are in the form of a layer of adhesive.

17. The cover according to claim 1, wherein the adhesive means are in the form of a polymer binder used during coextrusion of the films constituting the walls.

18. The cover according to claim 1, wherein the adhesive means are in the form of electric polarization of the facing surfaces of the walls, presenting opposite electrostatic fields.

19. The cover according to claim 1, wherein the walls constituting the sleeve are made from films of plastics material that are all mono-oriented, either all transversely or all longitudinally.

20. The cover according to claim 19, wherein the films constituting the walls have shrinkage curves and softening points that are essentially identical, said films possibly otherwise differing from one another in material, and/or color, and/or thickness, and/or texture.

* * * * *